United States Patent [19]

Miyake

[11] 4,018,233

[45] Apr. 19, 1977

[54] SHAPED MATTERS OF TOBACCOS AND PROCESS FOR PRODUCING THE SAME

[75] Inventor: Toshio Miyake, Okayama, Japan

[73] Assignees: Sumitomo Chemical Company Limited, Osaka; Hayashibara Biochemical Laboratories, Incorporated, Okayama, both of Japan

[22] Filed: June 16, 1975

[21] Appl. No.: 587,167

[30] Foreign Application Priority Data

June 29, 1974 Japan ..... 49-14829

[52] U.S. Cl. ..... 131/17 AC; 131/17 AD; 260/17.4 ST; 536/1

[51] Int. Cl.[2] ..... A24B 15/04; A24B 15/05; A24B 3/14

[58] Field of Search ..... 260/209 R, 17.4 ST; 131/17 R, 17 A, 17 AC, 17 AD, 2

[56] References Cited

UNITED STATES PATENTS

| | | | |
|---|---|---|---|
| 2,708,175 | 5/1955 | Samfield et al. | 131/17 AE |
| 2,769,734 | 11/1956 | Bandel | 131/17 AE |
| 2,778,753 | 1/1957 | Novak | 131/17 AC |
| 3,000,383 | 9/1961 | Tomasi | 131/17 AC |
| 3,009,835 | 11/1961 | Samfield et al. | 131/17 AC |
| 3,098,492 | 7/1963 | Wurzbourg et al. | 131/17 AC |
| 3,185,161 | 5/1965 | Fiore et al. | 131/17 AC |
| 3,297,039 | 1/1967 | Osborne et al. | 131/17 AE |
| 3,628,541 | 12/1971 | Buchmann et al. | 131/17 AC |
| 3,784,390 | 1/1974 | Hijiya et al. | 260/17.4 ST |
| 3,870,537 | 3/1975 | Hijiya et al. | 260/209 R |

*Primary Examiner*—Robert W. Michell
*Assistant Examiner*—T. S. Gron
*Attorney, Agent, or Firm*—Stevens, Davis, Miller & Mosher

[57] ABSTRACT

A shaped matter of tobacco excellent in aroma and flavor is obtained by coating and binding starting tobacco materials with pullulan or a pullulan derivative.

6 Claims, No Drawings

SHAPED MATTERS OF TOBACCOS AND PROCESS FOR PRODUCING THE SAME

This invention relates to a shaped matter of tobacco excellent in aroma and flavor, and to a process for producing the said shaped matter of tobacco, characterized by coating and binding various starting tobacco materials with pullulan, or a pullulan derivative such as a pullulan ester or a pullulan ether.

In recent years, shaped matters of tobaccos (sometimes called regenerated tobaccos) have come to be produced in large quantities from the viewpoints of increase in yield of tobacco production, enhancement in quality of tobacco products, and smoking hygiene.

Ever since shaped matters of tobaccos, particularly sheet-like shaped tobaccos, have come to be utilized, it has become possible that the bunching and wrapping steps for production of cigars and cigarrillos are mechanized to increase the efficiency of tobacco production remarkably. As to cigarettes, low-nicotine cigarettes have come to be desired, and therefore cigarettes have ordinarily been blended with about 5 to 30% of shaped matters of tobaccos.

With an aim to overcome the above-mentioned drawbacks, the present inventors conducted extensive studies to find that a tacky polysaccharide pullulan or a pullulan derivative is a markedly effective binder which can increase the strength of shaped matters of tobaccos and improve the aroma and flavor thereof.

An object of the present invention is to provide a shaped matter of tobacco excellent in aroma and flavor.

Another object of the invention is to provide a process for producing the said shaped matter of tobacco, characterized by coating and binding starting tobacco materials with pullulan or a pullulan derivative.

Other objects and advantages of the invention will become apparent from the following description.

The pullulan used in the present invention is a neutral tacky polysaccharide produced by microorganisms which have recently come to be produced in large quantities on industrial scale. It is such a high molecular weight substance that units of maltotriose have repeatedly been polymerized through $\alpha$-1,6-linkages which are different from those of said maltotriose, and has such chemical structure as represented by the formula,

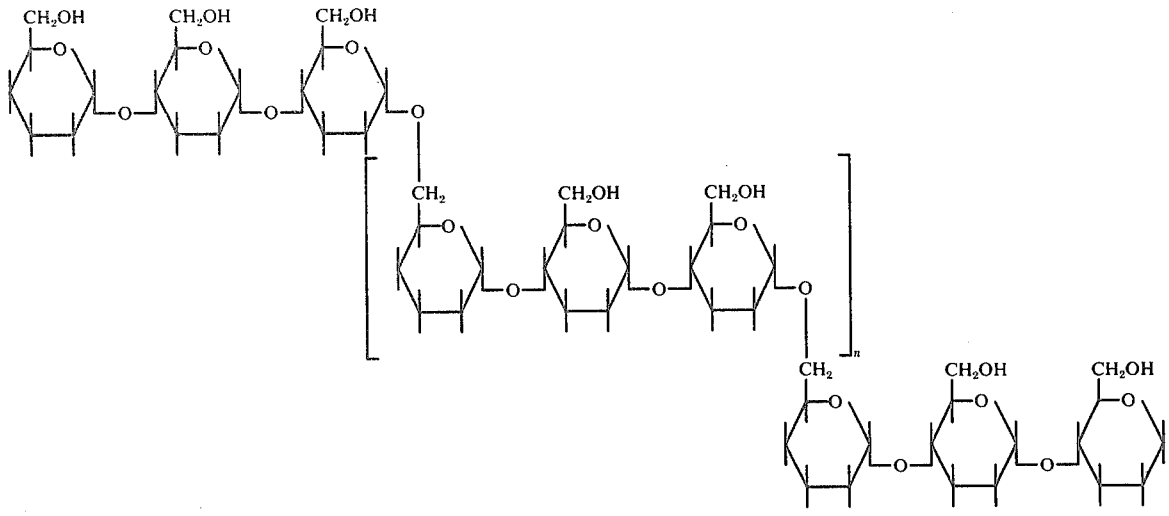

Factors that decide the aroma and flavor of tobacco products are the kind of leaf tobacco, the aged degree of leaf tobacco, the blend of leaf tobacco, the kind of added flavor, the moisture content of the products, the width of leaf tobacco shreds, the size and hardness of the tobacco products, and the use or non-use of filters.

In the case of shaped matters of tobaccos, however, the kind of binder used is the most important factor. Binders which have heretofore been used are cellulose derivatives such as carboxymethyl cellulose, methyl cellulose, ethyl cellulose and hydroxyethyl cellulose; starch derivatives such as carboxymethyl starch, methyl starch and ethyl starch; sodium alginate; and polyvinyl alcohol.

These conventional binders, however, have rather degraded the aroma and flavor of the resulting tobacco products, in general. Recently, therefore, there have come to be thought out even such shaped matters of tobaccos that no binder is used therein. However, the said shaped matters of tobaccos have such drawbacks as being low in tensile strength, bending strength and softness.

wherein $n$ is an integer of 20 to 10,000 which shows the polymerization degree.

The prominent effect of said pullulan or pullulan derivative on the improvement in aroma and flavor or shaped matters of tobaccos is considered ascribable to the specificity in chemical structure of the pullulan itself.

Other factors, which make the pullulan or pullulan derivative serve to improve the aroma and flavor and to increase the strength of shaped matter of tobacco, are as follows:

1. A pullulan film does not generate offensive taste and odor nor yields poisonous gases.
2. A film of the pullulan or pullulan derivative scarcely show permeability for gases, particularly oxygen, and hence can inhibit the degradation of tobacco components. Further, when leaf tobacco before completion of aging is coated with the pullulan, the aging time can be shortened.
3. The pullulan or pullulan derivative is high in aroma-retaining property, so that the aroma inherent to tobacco can successfully be retained by coating tobacco tissues therewith. If necessary, a pullulan or pullulan derivative solution containing hydrophilic, hydrophobic, volatile or non-volatile aroma substances is used to treat various starting tobacco materials, whereby the aroma substances can be stably maintained without any substantial change from the time of production to the time of smoking of the tobacco products. Accordingly, the amounts of expensive aroma substances can be reduced to a great extent.

4. The pullulan or pullulan derivative is less in change of equilibrium water content against humidity, and acts as a moisture-controlling agent. Accordingly, the amount of moisture-controlling agent can be reduced to a great extent.
5. The pullulan or pullulan derivative is not only strong in bonding strength but also forms a tough film, and hence can make the resulting tobacco product low in brittleness.
6. The pullulan or pullulan derivative is a binder which is extremely high in malleability, and hence can lower the resulting sheet-like tobacco product in basis weight (g/m²).
7. Due to the dilution effect derived from the use of the pullulan or pullulan derivative, the resulting shaped matter of tobacco can be lowered in nicotine content.
8. Since the pullulan or pullulan derivative is specific in chemical structure, the resulting shaped matter of tobacco forms less mold than in the case where starches are used.
9. For the same reason as in (8), the resulting shaped matter of tobacco is not stacked by insect pests.

Moreover, the pullulan is produced by fermentation of microorganism using starch as starting material, and hence has such advantage that it can be supplied in any required amount at any time, unlike in the case of other synthetic high polymers which are produced by using petroleum as starting material.

Pullulan can be easily obtained as a precipitate formed by subjecting a strain belonging to the genus Aureobasidium to aerobic stirring culture in a nutrient culture medium containing one or two or more of saccharides such as glucose, sucrose, fructose, invert sugar, date extract, partially hydrolyzed starch, etc., filtering the culture liquor to remove the cells of said strain, and then adding to the filtrate an organic solvent such as methanol or ethanol.

The average molecular weight of pullulan can be freely varied by varying the composition of medium and the cultivation conditions, and is in the range from 10,000 to 5,000,000. Examples of the strain belonging to the genus Aureobasidium are Aureobasidium pullulans IFO 4464, IFO 4465, IFO 4466, IFO 6353, IFO 6401, IFO 6402, IFO 6403, IFO 6405, IFO 6406, IFO 6419, and IFO 6725.

The thus obtained pullulan can be easily etherified or esterified according to an ordinary procedure to form a derivative, which is also preferable, like pullulan, as a binder for use in the production of shaped matter of tobacco. The pullulan derivative referred to in the present invention signifies such etherified or esterified pullulan as mentioned above. If necessary, there may be used a pullulan derivative prepared by combining pullulan with an aroma substance. The substitution degree of such derivative is at most 3 but is preferably about 1.0 or less, in general.

Main starting materials usable in the present invention are tobacco wastes and by-products such as leaf wastes, shred wastes, midribs, roots and stems of tobaccos; fragments and powders of leaf tobaccos and shreaded tobaccos; and calluses or tissues prepared by subjecting the cells of tobaccos to tissue culture.

As processes for production of shaped matters to tobaccos, there are papermaking type, spreading type, slurry type, rolling type and granulation type processes. Even when any of said processes is adopted, the pullulan or pullulan derivative used in the present invention can easily give a shaped matter of tobacco which is excellent in aroma and flavor.

The papermaking type process is carried out by cooking and heating midribs and the like of tobacco leaves, and then molding the resulting liquor to the form of sheet by use of a papermaking machine, like in the case of the usual papermaking process. In this case, the papermaking operation is effected while recycling water in order to inhibit the flowing-out of soluble aroma components or, if necesary, while adding various aroma substances. When the papermaking operation is carried out by use of water containing 0.01 to 5 wt% of pullulan or pullulan derivative, a shaped matter of tobacco excellent in aroma and flavor can be obtained.

The spreading type process is carried out by spreading a starting tobacco powder on a stainless steel-made endless belt, spraying onto said tobacco powder a small amount of an aqueous solution containing 1 to 40 wt% of pullulan or pullulan derivative, and further spreading thereon the starting tobacco powder, followed by drying. If necessary, the above operation may be repeated several times to form a laminate.

The slurry type process is carried out by homogeneously mixing an aqueous solution containing 1 to 40 wt% of pullulan or pullulan derivative with a starting tobacco powder or fiber to form a slurry, and applying the thus formed slurry onto a stainless steel-made endless belt so as to form a thin layer, followed by drying to obtain a shaped matter of tobacco.

The rolling type process is carried out in such a manner that a powdery or fragmentary starting tobacco material, which is under mixing, is sprayed with an equivalent or less, based on said starting tobacco material, of an aqueous solution containing 1 to 40 wt% of pullulan or pullulan derivative, or a homogeneous mixture of the starting tobacco material with a powder of pullulan or pullulan derivative is sprayed with an equivalent or less, based on the starting tobacco material, of water or a flavor solution, and then the thus treated tobacco material or mixture is subjected to a roller or an extruder to obtain a shaped matter of tobacco. In case the thus obtained shaped matter of tobacco is excessively great in basis weight, the shaped matter of tobacco can be lowered in basis weight by heating and expanding the same at 100° to 160° C. If necessary, a foaming agent such as baking powder or the like may also be used.

In the granulation type process, various procedures may freely be employed. For example, in the case of rotary granulation, a starting tobacco powder is mixed with 0.1 to 5 times the weight thereof of pullulan or pullulan derivative containing 15 to 40% of water, and the resulting mixture is granulated by means of a rotary granulator and then controlled in moisture content. In the case of usual granulation, a starting tobacco powder is mixed with 0.2 to 5 times the weight thereof of pullulan or pullulan derivative containing 15 to 50% of water, and the resulting mixture is granulated by means of a granulator and then controlled in moisture content. The thus obtained shaped matter of tobacco granules are desirably used in a proportion of 50% or less as blend of leaf tobacco for shreded tobaccos.

The time of mixing of pullulan or pullulan derivative with a starting tobacco material may be any stage so far as the two can be homogeneously mixed with the other. The mixing proportions of the two vary depending on the manner of production of shaped matter of tobacco, the molecular weight of pullulan used, etc. In view of the tensile strength and bending strength of the product, however, the proportion of pullulan or pullulan derivative is 0.1 to 500, preferably 1 to 100 parts by weight per 100 parts by weight of starting tobacco material.

The content of pullulan or pullulan derivative in a tobacco product at the time of smoking should be 50% or less. However, in the case where the aroma has been enriched by use of a tobacco extract or the like, and in the case where extremely light aroma and flavor are required, the proportion of pullulan or pullulan derivative may exceed 50%, though the upper limit thereof is 50% even in such cases.

The shaped matters of tobaccos of the present invention are quite satisfactory not only as blend of leaf tobacco for cigarettes but also as bunching and wrapping materials for cigars and cigarrillos.

The pullulan employed in the present invention may be used in admixture with various pullulan derivatives. Further, the pullulan and pullulan derivatives may be used in combination with other binders, moisture-controlling agents, reinforcing agents, flavors, etc.

The present invention is illustrated in detail below with reference to examples. In the examples the parts means parts by weight.

REFERENCE EXAMPLE 1

Preparation of pullulan:

a. A seed culture liquor was prepared by subjecting a strain *Aureobasidium pullulans* IFO 4464 to aerobic stirring culture at 27° C for 2 days in a medium (adjusted to an initial pH of 7.0) comprising 10% of partially hydrolyzed starch (Dextrose Equivalent: 50), 0.2% of $K_2HPO_4$, 0.2% of NaCl, 0.2% of peptone, 0.04% of $MgSO_4.7H_2O$, 0.001% of $FeSO_4.7H_2O$, and the balance of city water. To a main culture medium of the same composition as above was added 2 v/v%, based on the saccharide, of the above-mentioned seed culture liquor, and aerobic stirring culture was conducted at 27° C for 7 days. From this culture liquor, the cells were removed by filtration, and the filtrate was decolored by addition of 1%, based on the saccharide, of powdery active carbon, and was then subjected to filtration. To the resulting filtrate, methyl alcohol in a volume equal to that of the filtrate was added to deposit precipitates. The precipitates were recovered by centrifugation, washed with methanol and then vacuum-dried to obtain a pullulan having an average molecular weight of about 400,000. The yield based on the saccharide was 60%.

b. The same cultivation as in (a) was conducted, except that the strain was varied to *Aureobasidium pullulans* IFO 6353 and the amount of $K_2HPO_4$ was increased to 0.5%, to obtain a pullulan having an average molecular weight of about 50,000. The yield based on the saccharide was 70%.

REFERENCE EXAMPLE 2

Preparation of pullulan derivative:

a. A mixture comprising 50 parts of the dried pullulan obtained in Reference Example 1 (a) and 100 parts of pyridine was dissolved in 500 parts of dimethyl formamide. Into the resulting solution, 30 parts of acetic anhydride was dropped with stirring at 65° C over a period of 1 hour. After the dropping, the resulting mixture was reacted for 1 hour at the same temperature, and was then cooled. Thereafter, the reaction liquid was incorporated with methyl alcohol to deposit precipitates of pullulan ester. The precipitates were recovered by filtration and again dissolved in water, and the resulting solution was incorporated with methyl alcohol to deposit precipitates, which were then recovered, washed and dried to obtain 45 parts of a pullulan ester. The substitution degree of the thus obtained pullulan ester was 0.6.

b. 900 Parts of the pullulan obtained in Reference Example 1 (b) was dissolved in 3,500 parts of a 5% aqueous sodium hyroxide solution. The resulting solution was degased and then reacted with stirring in a nitrogen gas atmosphere at 40° C for 5 hours while dropping 150g of ethylene oxide into said solution. Thereafter, the reaction liquid was neutralized with acetic acid, and then incorporated with methanol to form a pullulan hydroxyethyl ether, which was then recovered, washed with 90 v/v% methanol and dried. The amount of the thus obtained pullulan hydroxyethyl ether was 860 parts, and the substitution degree thereof was 0.3.

EXAMPLE 1

50 Parts of a starting tobacco powder of the yellow grade was mixed with 200 parts of a 5% aqueous solution of the pullulan obtained in Reference Example 1 (a) and with 0.1 part of maltitol. The resulting mixture was extruded through a 0.2 mm slit onto a stainless steel-made endless belt, and then dried with infrared rays to obtain 65 parts of a sheet tobacco having a water content of 13%. This product is preferable not only as blend of leaf tobacco for cigarettes but also as bunching and wrapping materials for cigars and cigarrillos.

EXAMPLE 2

To 10 parts of midribs of tobacco leaves of the yellow grade was added 200 parts of an aqueous solution which had separately been prepared by extracting midribs of tobacco leaves with water, and the resulting mixture was sufficiently beaten by means of a beater. The beaten mixture was incorporated with 0.4 part of the pullulan obained in Reference Example 1 (b) and 3 parts of a yellow grade tobacco powder, and then subjected to papermaking type treatment process to obtain a shaped matter of tobacco. The thus obtained shaped matter of tobacco was dried in the same manner as in Example 1 to obtain 13 parts of a shaped matter of tobacco having a water content of 12%. This product is particularly preferable as bunching and wrapping materials for cigars and cigarrillos.

EXAMPLE 3

In this Example were used 10 parts of a yellow grade tobacco powder and 15 parts of an aqueous solution containing 2% of the pullulan ester obtained in Reference Example 2 (a) and 0.05% of glycerin.

The starting tobacco powder was spread to the form of a layer on a stainless steel-made endless belt, the aqueous solution containing pullulan ester and glycerin was uniformly sprayed onto said tobacco powder layer to such an extent as to wet the layer, and then the tobacco powder was uniformly spread on the layer. This operation was repeated two more times to form a laminate. The thus formed laminate was dried in the same manner as in Example 1 to obtain a shaped matter of tobacco having a water content of 12%. This product is preferable not only as blend of leaf tobacco for cigarattes but also as bunching and wrapping materials for cigars.

EXAMPLE 4

100 Parts of a yellow grade tobacco powder was sufficiently mixed with 50 parts of a 5% aqueous solution of the pullulan ether obtained in Reference Example 2 (b). The resulting mixture was roll-molded by use of a roll, foamed by heating at 140° C, and then moistened at 20° C and relatively humidity (RH) of 60% to obtain 110 parts of a shaped matter of tobacco having a water content of 12%. This product is particularly preferable as blend of leaf tobacco for cigarettes.

EXAMPLE 5

Commercially available cigarettes were loosened to take out tobacco shreds. 10 Parts of the tobacco shreds were sprayed with an aqueous solution containing as a binder 0.5 part of each of pullulans, pullulan derivatives and carboxymethyl cellulose, dried with an infrared lamp, and then moistened at 20° C and 60% RH for one month. Subsequently, the tobacco shreds were formed into cigarettes of the same weight as that of commercially available cigarettes. The thus obtained cigarettes were subjected to smoking tests to compare them in aroma and flavor.

The tests were carried out by comparing according to two-point method the aroma and flavor of the cigarettes using the control carboxymethyl cellulose with those of the cigarettes using each of pullulans and pullulan derivatives. In one test, five panels were employed and four test areas were used, so that the total number of the answers obtained was 20. Among these answers, the number of answers given by panels, who judged that the cigarettes using each of pullulans and pullulan derivatives were more favorable in aroma and flavor, was as shown in Table 1.

Table 1

| Binder | Number of panels who judged more favorable |
|---|---|
| Pullulan obtained in Reference Example 1 (a) | 19 |
| Pullulan obtained in Reference Example 1 (b) | 20 |
| Pullulan ester obtained in Reference Example 2 (a) | 18 |
| Pullulan ether obtained in Reference Example 2 (b) | 19 |

Table 1-continued

EXAMPLE 6

The shaped matters of tobaccos obtained in Examples 1 to 4 were shreded to the same size as that of tobacco shreds used in commercially available cigarettes, and were moistened at 20° C and 60% RH for one month. Commercially available cigarettes were loosened to take out tobacco shreds in the same manner as in Example 5, and 50% of the tobacco shreds were replaced by the moistened tobacco shreds mentioned above to prepare samples.

As control samples, there were used cigarettes in which each of the pullulans and pullulan derivatives used in Examples 1 to 4 was replaced by carboxymethyl cellulose.

The above-mentioned samples were subjected to the same tests as in Example 5 to obtain such results as shown in Table 2.

Table 2

| Kind of sheet tobacco | Binder | Number of panels who judged more favorable |
|---|---|---|
| Example 1 | Pullulan | 20 |
| Example 2 | Pullulan | 19 |
| Example 3 | Pullulan ester | 18 |
| Example 4 | Pullulan ether | 20 |

As is clear from the results shown in Table 2, the pullulan or pullulan derivative used in the present invention is more prominent in effect of improving th aroma and flavor of tobacco products than the carboxymethyl cellulose which is widely available at present.

What is claimed is:

1. A shaped solid smoking composition, the smoke produced by its combustion being pleasant in aroma and flavor, which composition comprises starting tobacco materials coated with and coated together with a material selected from the group consisting of pullulan, etherified pullulan, and esterified pullulan.

2. A shaped solid smoking composition according to claim 1, wherein the molecular weight of the pullulan is 10,000 to 5,000,000.

3. A shaped solid smoking composition according to claim 1, wherein the coating and bending material pullulan is an etherified or esterified pullulan.

4. A shaped solid smoking composition according to claim 1, wherein the starting tobacco materials are leaf wastes, shred wastes, midribs, roots or stems of tobaccos, fragments or powders or leaf tobaccos or shreded tobaccos, or calluses or tissues of tobaccos.

5. A shaped solid smoking composition according to claim 1, wherein the ratio of starting tobacco materials to the coating and binding material is 100 : 0.1 to 100 : 500 by weight.

6. A shaped solid smoking composition according to claim 1, wherein the coating and binding material is used in combination with at least one member selected from the group consisting other binders, moisture-controlling agents, reinforcing agents and flavors.

* * * * *